US005555079A

United States Patent [19]

Adachi et al.

[11] Patent Number: 5,555,079

[45] Date of Patent: Sep. 10, 1996

[54] IMAGE FORMING APPARATUS FOR PREVENTING DAMAGE TO CONDUCTIVE FIBERS ON A CHARGING MEMBER

[75] Inventors: Katsumi Adachi, Nara; Takashi Hayakawa, Kyoto, both of Japan

[73] Assignee: Sharp Kabushiki Kaisha, Osaka, Japan

[21] Appl. No.: 341,060

[22] Filed: Nov. 16, 1994

[30] Foreign Application Priority Data

Nov. 25, 1993 [JP] Japan ..... 5-295353

[51] Int. Cl.[6] ..... G03G 15/02

[52] U.S. Cl. ..... 355/219; 355/245; 355/296

[58] Field of Search ..... 361/225; 355/219, 355/245, 296

[56] References Cited

U.S. PATENT DOCUMENTS

| | | | |
|---|---|---|---|
| 4,336,565 | 6/1982 | Murray et al. | 361/225 |
| 5,398,102 | 3/1995 | Wada et al. | 355/219 |
| 5,430,527 | 7/1995 | Maruyama et al. | 355/219 |

FOREIGN PATENT DOCUMENTS

| | | | |
|---|---|---|---|
| 63-43749 | 1/1988 | Japan . | |
| 64-7070 | 1/1989 | Japan . | |
| 3-100673 | 4/1991 | Japan . | |
| 5181345 | 7/1995 | Japan | 355/219 |

*Primary Examiner*—Joan H. Pendegrass
*Assistant Examiner*—Quana Grainger
*Attorney, Agent, or Firm*—Nixon & Vanderhye

[57] ABSTRACT

In an image forming apparatus including a charging element, a charged element, a developing element, and a cleaning element the dimensions of those elements satisfy either or both of the following relations:

$$C+D<A<B-D$$

$$C<E<A+D$$

where A denotes a longitudinal dimension of the charging element; B denotes an effective longitudinal width of a photoconductive layer coated range on the charged element; C denotes a developing width in the longitudinal direction of a developing element; D denotes a vibrating width of the charging member; and E denotes a longitudinal dimension of a cleaning element for the charged element.

6 Claims, 11 Drawing Sheets

IMAGE FORMING APPARATUS FOR PREVENTING DAMAGE TO CONDUCTIVE FIBERS ON A CHARGING MEMBER

BACKGROUND OF THE INVENTION (1) Field of the invention

The present invention relates to an image forming apparatus using an electrophotographic process such as a photocopier, a printer and the like.

(2) Description of the Prior Art

In image forming apparatus using so called electrophotographic process (Carlson process), corona charging devices that utilize the corona discharge phenomenon have been used as typical means for charging an electrophotographic photoconductor at a desired potential level. This method, however, requires a high discharge voltage, which results in electric noises affecting various peripheral apparatus. Alternatively, a large quantity of ozone gas generated in discharge gives an unpleasant feeling to people around the machine. To deal with these problems, as alternatives to corona discharging devices, a method has been proposed in which a photoconductor is charged by applying a voltage between the photoconductor and a conductive resin roller or conductive fibers. Nevertheless, this method suffers from another problem. That is, in a case of a conductive resin roller, if a micro-area of a photoreceptive layer of the photoconductor to be charged is peeled off and therefore part of a conductive substrate such as aluminum, etc., is exposed, electric current from the roller converges into the exposed portion, thereby causing striped charging unevenness extending across the photoconductor in its axial direction. Brush type charging devices using conductive fibers can be roughly classified into two kinds: one has fibers planted on a belt-like strip and the other of which has fibers planted on a roller. Either of these could eliminate striped charging unevenness which arises when the aforementioned conductive resin roller is used.

Nevertheless, when the belt-like brush charging device is used, another kind of image defect arises. Specifically, brushing stripes which run in the advancing direction of sheets arise on the image. This is because each position across the longitudinal direction of the charged member or photoconductor comes into contact with the same part of fibers on the charging brush. That is, if some parts of fibers have less charging ability than other parts, the portion of the charged member contacting with the part of fibers having less charging ability will be charged at a lower surface potential while the portion contacting with the part of fibers having higher charging ability will be charged at a higher surface potential. This causes charging unevenness across the longitudinal direction of the charged member, thereby generating brushing stripes in the advancing direction of sheets. Further, depending on the contacting strengths at contact points between the charging brush and the charged member, the degree of wear to the charging brush and the charged member will differ, that is, some parts will be worn out faster while other parts will not. As a result, charging failure occurs earlier at the portion having been worn out shortening the lives of the brush and the charged member.

To deal with this, it has been disclosed in Japanese Patent Publication Sho 63 No.43749 that the charging brush is vibrated in the direction perpendicular to the moving direction of the charged member. Actual images created as the charging brush is vibrated were found to be free from the brushing stripes running in the advancing direction of sheet which appeared when the brush was fixed. Further, it was confirmed that the lives of the charging member and the charged member were markedly lengthened.

FIGS. 1 and 2 are illustrative views showing configurations of prior art examples. In the figures, A, B, C and D indicate:

A: Length of a charging member;

B: Effective width of a photoconductive layer applied on charged member;

C: Developing width; and

D: Vibrating width of the charging member.

Further, reference numeral 1 designates a photoconductor while numerals 1*a* and 1*b* denote a photoconductive layer coated range and a conductor substrate, respectively.

Initially, in the case shown in FIG. 1, where A+D>B, when a charging member 5 is vibrated, the longitudinal extremes of the charging member 5 are made to interfere with the conductive substrate portion 1*b* on the charged member 1, giving rise to the following problems.

i) Current leak occurs at contacting portions 21 and 22 between the charging member 5 and the conductive substrate 1*b*, and in consequence, excessive current flows through the charged member 1, causing damage thereto.

ii) In the case where capacity of the power source for the charging device is small or the charging device comes into contact with the conductive substrate 1*b* in a large area, very few of charges can be supplied to the photoconductive layer portion 1*a* or the non-conductive portion of the charged member 1, whereby those portions are isolatedly reduced in surface potential causing image defects.

The above problem can be solved when the contact width, i.e., A+D between the charging member and the charged member is set up to be shorter than the effective width B of the charged member. In other words, (the charging member length+the vibrating width) should be smaller than (the effective width of the photoconductive layer applied on charged member) or a relation "A+D<B" should hold.

Next, let us consider the case shown in FIG. 2. When the charging member having a length of A with a vibrating width of D is brought into contact with the charged member to charge it, the width of the range within which the charging member is always in contact with the charged member is (A–D) and therefore only this region can be uniformly charged at a desired surface potential. If the length (A–D) is shorter than the effective developing width C, or C >A–D, the following problems occur.

i) Since edge regions 23 and 24 on the charged member 1 come in contact with the charging member 5 for a shorter time than the middle part of the claimed member 1 and therefore cannot be charged at a sufficiently high surface potential level. Overlapping areas 25 and 26 of regions 23 and 24 overlap with the developing width region C and therefore are toner-developed when development (as performed in laser printers) is executed. As a result, toner debri forms on a transfer member and is wasted. Further, the toner which could not be cleaned up and remains on the charged member may adhere to the charging brush which decrease its charging ability resulting in occurrence of charging unevenness.

ii) Further, since development is always effected in the regions 25 and 26, toner particles, not having been collected efficiently for prolonged use, adhere to a conductive fabric cloth 5*a*, thereby causing charging unevenness and giving bad influences on resulting images. Further, the developer is consumed rapidly.

This problem can be solved by setting up the width (A–D) of the region which can always be charged at the desired level to be greater than the developing width C. Therefore, a relation "A–D>C" should hold. It should be noted that this requirement can, of course, be applied to the normal development mode which is performed in photocopiers and the like.

Japanese Patent Application Laid-open Hei 3 No.100673 discloses an idea which defines, in an image forming apparatus using a charging member with conductive fibers, dimensional relations as to its charging member width, developing width and charged member width. FIG. 3 illustrates the idea in which the configuration aims at uniform charging of the entire surface of a photoconductive layer as well as extermination of smudge and failure of resulting images. To achieve these purposes, an insulating layer is provided on each extreme of a conductive substrate 1*b* in order to prevent a charging member 5 from being short-circuited with a charged member 1 while specific limitations are imposed on effective widths of constituting parts. The technique shown in FIG. 3, however, only specifies the length A of the charging member, the effective length B of the charged member and the developing width C so as to satisfy a relation A>B>C. Still, this technique can be applied only to configurations in which the charging member 5 is not vibrated. Accordingly, this technique is quite different from the art now being discussed in question in which the charging member 5 is vibrated, and naturally, the relation among the effective width A, B and C does not include the aforementioned vibrating width D. For this reason, the description of the technique of FIG. 3 is mentioned only for reference and no further discussion on the technique of FIG. 3 will be made.

FIGS. 4 and 5 are illustrative views showing other configurations of a prior art example. In the figures, A, B, C and D indicate:

A: Length of a charging member;

C: Developing width;

D: Vibrating width of the charging member; and

E: Length of a cleaning member.

Initially, in the case shown in FIG. 4, where E<C, the following problems occur.

i) There exist regions 27 and 28 in which it is difficult to collect developing particles not having been transferred and therefore remaining on a charged member 1. This remaining toner adheres to a charging member 5. The thus adhered toner particles are further spread out to wider ranges by the vibrating charging member 5, polluting the image region. Moreover, the adherent particles fix to conductive fiber portions 5*a* of the charging member 5, thereby likely causing charging defects.

ii) With a charging member 5 made up of conductive fibers 5*a*, those fibers may detach from the charging member and the detach fibers may adhere to the charged member 1 in the contacting width range between the charging member 5 and charged member 1. Particularly, existence of the detach fibers adhered to places on the charged member near the image region may have an adverse influence on image forming. Hence, removal of the fallen fibers is important. Nevertheless, the aforementioned condition, i.e., E<C, is not enough for removing fibers fallen in regions 27 and 28.

In order to solve the problems above, it is necessary to make the width of the cleaning member wider than, at least, the effective developing width, that is, a relation "E>C" must hold. Therefore, consider the case shown in FIG. 5, wherein a relation "E>A+D" holds. In other words, a cleaning member is provided so as to reach regions 29 and 30 outside the contacting region (A+D) between a charging member 5 and a charged member 1 where very few adherent substances such as developer, fallen conductive fibers and the like exist on the charged member 1. In this case, the following problems occur.

i) In such regions 29 and 30 to which, in practice, only a few adherent substances adhere, frictional force generated between the cleaning member and the charged member 1 tends to become greater, therefore a stronger load torque is required for driving the charged member 1. Further, when the cleaning member is of a blade-type, the blade may be bent backward, and also, this bent blade could damage the charged member 1. Moreover, the cleaning structure becomes enlarged, disadvantageously raising its cost.

To solve the problem, it is necessary to set up the width E of the cleaning member smaller than the contacting width between the charging member 5 and the charged member 1, i.e., a relation "E<A+D" must hold.

Japanese Patent Application. Laid-open Sho 64 No.7070 discloses an idea which defines, in an image forming apparatus in which a charged member 1 is charged by bringing a charging member 5 into contact with the charged member 1, dimensional relations as to its charging member width, developing width and cleaning member width.

This technology originally assumes the use of an organic photo-conductor (OPC) as a charged member 1. Hence, the disclosure exemplified several experimental results for different kinds of OPCs. FIG. 6 is an illustrative view schematically showing a typical configuration of this prior art technology. In this configuration, a relation is defined in which a width E should at least contain a region $A_1$, where $A_1$ denotes the region across which a charging member 5 comes in contact with a charged member 1 while E denotes the width of a cleaning member used. Here, the charging member 5 can be selected from those usually used such as of a roller type, a brush-type etc. The reason why the above relation between the region $A_1$ and the width E of the cleaning member should be defined, that if the small amount of adhered substances existing outside the contacting width between the charging member 5 and the charged member 1 are trapped in regions 31 and 32 between the charging member 5 and the charged member 1, these particles generate pinholes especially when the charged member 1 is made up of those having a low surface hardness such as OPCs. Even if these pinholes exist in areas outside the image region, current leakage occurs when the charging member 5 comes in contact with the pinholes, thus causing adverse effect on resulting images.

The above-described effect is likely to happen or could occur mainly when the charging member 5 used is of a resin roller type or the like, but in the cases shown in FIGS. 1, 2, 4 and 5 in which the charging member 5 used is of a conductive fiber type, generation of pinholes hardly occurs due to adhered substances caught between the charging member 5 and charged member 1. Even the existence of pinholes outside the image region usually does not adversely input resulting images. Further, this disclosure does not have any reference to the configuration of the vibrating charging member 5. Although the aforementioned contacting region $A_1$ between the charging member 5 and the charged member 1 is to correspond to A+D, (or the charging member length A plus the vibrating width D in the cases shown in FIGS. 1, 2, 4 and 5) it is difficult to compare the configuration shown FIG. 6 equally with those cases since no vibration of the charging member is effected in the configuration of FIG. 6.

To sum up, the following problems occur in systems in which the charging member 5 is brought into contact with the charged member 1 with the charging member 5 being vibrated.

First of all, as concerning the dimensional relation among the charging range width determined by the width of the charging member 5 and its vibrating width, the width of the photoconductive layer coated range 1*a* on the charged member 1 and the developing width, the following problems occur.

1) In the case where the charging member 5 is in contact with the conductive portion 1*b* of the charged member 1, excessive current flows through the charging member 5, causing damage to the charging member 5. Alternatively, in the case where the capacity of a power supply for the charger is low or in the case where the charger is in contact with the conductive substrate 1*b* over a large area, electric charges are not sufficiently supplied to the photoconductive layer portion 1*a*, or the non-conductive portion of the charged member 1, whereby the portions are isolatedly reduced in surface potential causing image defects.

2) In the case where a region to be charged at a desired surface potential (length of the region corresponds to "the charging member length–the vibrating width") is shorter than the developing width, outer edge portions of the photoconductor corresponding to both extremes of the brush are not brought into contact with the brush for sufficiently long time, so that it is impossible to charge the portions to the desired level. Therefore, as in the reversal developing process adopted as in laser printers etc., the outer edge portions with less surface potential levels always bear toner, causing smudge of the transfer member or waste of toner. Further, the toner which could not be cleaned up may adhere to the charging brush, whereby the charging brush might be deteriorated in its charging ability for prolonged use, causing charging unevenness.

Regarding the dimensional relation among the charging range width determined by the width of the charging member 5 and its vibrating width, the developing width and the length of the cleaning member, the following facts can be pointed out.

1) In order to collect the remaining developer on the charged member 1, it is necessary to make the cleaning member longer than the effective developing width. Further, in the case where the charging member 5 is made up of conductive fibers 5*a*, the conductive fibers 5*a* may fall out from the charging member 5 within the contacting width range between the charging member 5 and the charged member 1. Fallen fibers in locations near the image region might adversely influence image. Therefore, the removal of the fallen fibers is very important.

2) If the cleaning member is too long, the frictional force between the cleaning member and the charged member 1 becomes greater in the regions to which, in practice, only a small amount of developer, fallen fibers and the like adhere, therefore, a stronger load torque is required for driving the charged member 1. Further, when the cleaning member is composed of a blade-type member, the blade may be bent backward and could cause damage to the charged member 1. Moreover, the enlarged cleaning structure raises its cost.

SUMMARY OF THE INVENTION

It is therefore an object of the present invention to solve the above problems. An image forming apparatus comprises:

a charged member; and a charging member with conductive fibers, placed in contact with the charged member so as to share at least a contact surface or micro-space between the two members while being vibrated in directions perpendicular to a moving direction thereof wherein a voltage is applied between the charging member and the charged member so as to charge the charged member, and is constructed such that elements are set up so as to satisfy any one or both of the following relations (a) and (b):

$$C+D<A<B-D \quad \text{(a)}$$

$$C<E<A+D \quad \text{(b)}$$

where A denotes a longitudinal width of the charging member; B denotes an effective longitudinal width of a photoconductive layer coated range on the charged member; C denotes a developing width in the longitudinal direction of a developing unit; D denotes a vibrating width of the charging member; and E denotes a longitudinal dimension of a cleaning member for the charged member.

In the above configuration, the charging member comprises a charging brush having conductive fibers affixed on a base thereof or a charging roller composed of a roller shaft with a conductive fiber cloth spirally swathed thereon.

By the above configuration, it becomes possible to provide an image forming apparatus which is able to use a practical developer with a charging member composed of conductive fibers and wherein the charging member can be prevented from being damaged so that good image printing can last for a prolonged period of time with reduced generation of ozone gas.

DESCRIPTION OF THE PREFERRED EMBODIMENTS

The present invention will hereinafter be described in detail based on embodiments with reference to the accompanying drawings. It is to be understood that the present invention is not limited by the embodiments herein.

Figure 7:
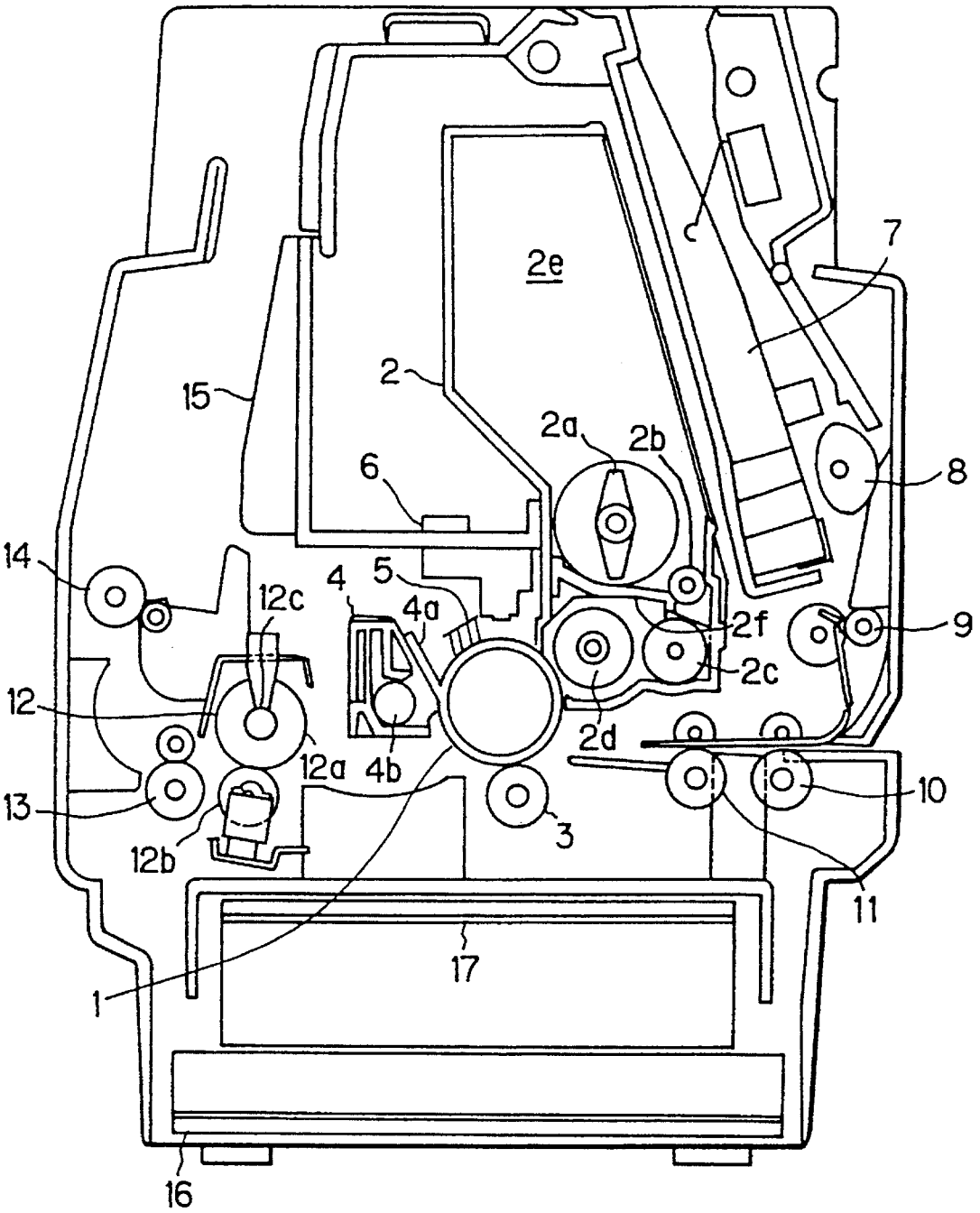
FIG. 7 is a front view schematically illustrating an image forming apparatus as a target of the present invention.
Figure 8:
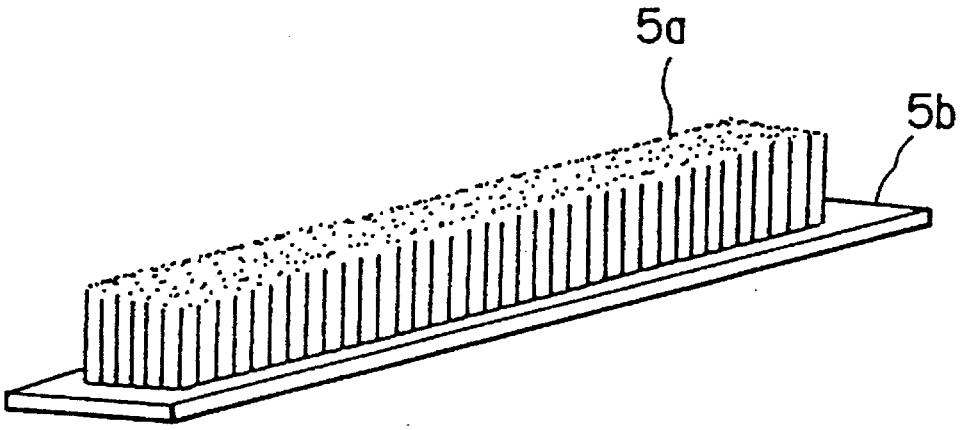
FIG. 8 is a perspective view showing one example of a charging brush used in the present invention.

In the beginning, referring to FIG. 7, one typical image forming apparatus in which the present invention may be used will be explained. Conductive fibers are planted on a flat structure. A reference numeral 16 designates a controller which processes image-generating data transmitted from an unillustrated host computer. Subsequently, a signal that dictates start of image forming is sent to an engine controller 17. In response to the signal, a series of operations for image forming is executed in accordance with a predetermined sequence. Transfer sheets accommodated in a transfer sheet cassette 7 is successively drawn out one by one by a feed roller 8 and conveyed by conveyer rollers 9, 10 to a registration roller 11. A photoconductor 1 is rotated at a constant rate by an unillustrated rotating means. A charging brush 5 is pressed against the photoconductor 1 with a 1 mm-biting margin. The biting margin is the amount of overlap of the conductive fibers 5*a* of the charging brush 5*b* with the photoconductive drum 1. The charging brush 5 used here is composed as perspectively shown in FIG. 8 of a conductive base (made from aluminum, iron etc.) 5*b* and conductive fibers or conductive fiber cloth 5*a* affixed on the conductive base 5*b*. Here, the conductive fiber cloth 5*a* is formed with fibers or fiber aggregation made of, for example, rayon with an adjusted amount of carbon dispersed therein so as to obtain a desired resistance. Conductive fibers of 4 mm long were used for the charging brush of this embodiment. The charging brush can be vibrated by an unillustrated vibrating means in directions perpendicular to a moving direction of the photoconductor. The vibrating means used in the image forming apparatus of this embodiment can be varied in vibrating frequency f from 0 to 10 Hz and in vibrating width D from 0 to 15 mm. The photoconductor used is an organic photoconductor (OPC) as is known in the prior art.

Figure 9:
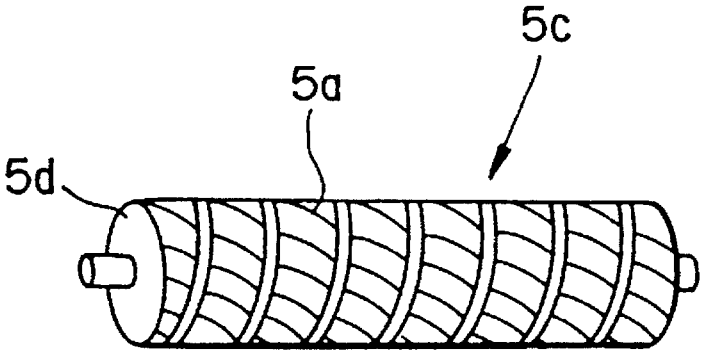
FIG. 9 is a perspective view showing one example of a charging roller used in the present invention.

FIG. 9 is a perspective view showing a charging roller 5*c* which is applicable as the charging member of the present invention. This charging roller 5*c* is constructed of a roller shaft 5*d* and a strip of conductive fiber cloth 5*a* spirally wrapped on the roller shaft 5*d*.

Meanwhile, in a developing unit 2, in order to assure that a magnet roller 2*d* may provide toner having a predetermined toner density, toner powder is supplied from a toner tank 2*e* through an agitating roller 2*a* within, as required, by a supplying roller 2*b* to developer hopper 2*f*, and the thus supplied toner powder is agitated by a mixer roller 2*c*. During the agitation, the toner is electrified to bear charges of the same polarity with that of the voltage to be charged onto the photoconductor. In this state, when a voltage close to the surface potential of the photoconductor is applied to the magnet roller 2*d*, the toner powder adheres to a portion of the photoconductor that an exposure writing head 6 has irradiated, and thus the latent image is developed. A registration roller 11 sends out a transfer sheet so that the sheet is positioned corresponding to an image on the photoconductor 1. The transfer sheet is nipped and conveyed between the photoconductor 1 and the transfer roller 3. During this, the transfer roller 3 is impressed by a voltage of an opposite polarity to that of the toner. Therefore, toner particles on the photoconductor 1 move onto the transfer sheet. The transfer sheet having toner particles thereon is nipped and conveyed between a heat roller 12*a* with a heater 12*c* incorporated therein and a pressure roller 12*b* in a fixing unit 12. In this way, the toner particles are fused and fixed on the transfer sheet. Then, the transfer sheet is conveyed by a conveying roller 13 and a paper discharging roller 14 to a stack guide 15. Meanwhile, toner that was not transferred and remains on the photoconductor 1 is scraped from the photoconductor 1 by a cleaning member 4*a* of a cleaning unit 4. Thus scraped toner is sent by a toner conveying screw 4*b* to a used toner collecting container (not shown). Thus, a series of operations for image forming is complete. Here, in the present embodiment, three of blade-type cleaning members having different lengths were used, i.e., 210 mm, 230 mm and 240 mm, were used. With the thus constructed image forming apparatus, the effect of the present invention was confirmed.

Embodiment I

Figure 1:
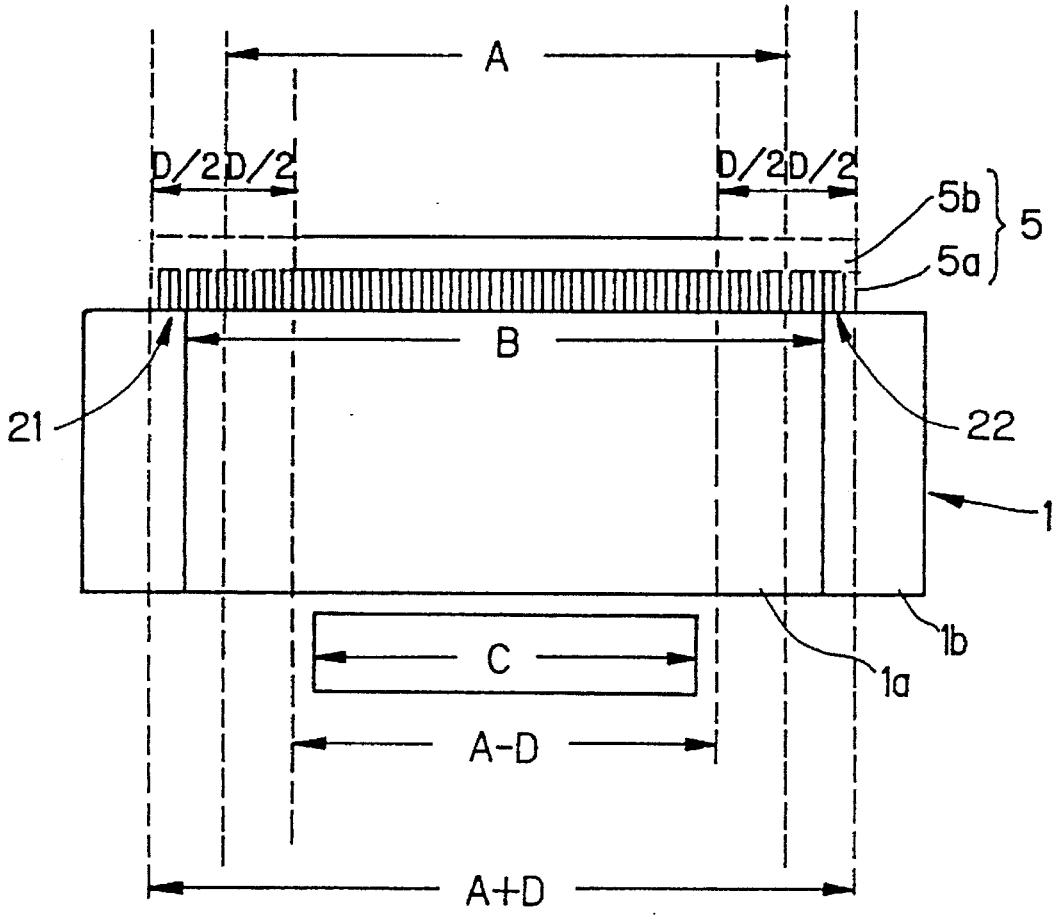
Fig.1 PRIOR ART
FIG. 1 is an illustrative view showing one configuration of one prior art example.
Figure 2:
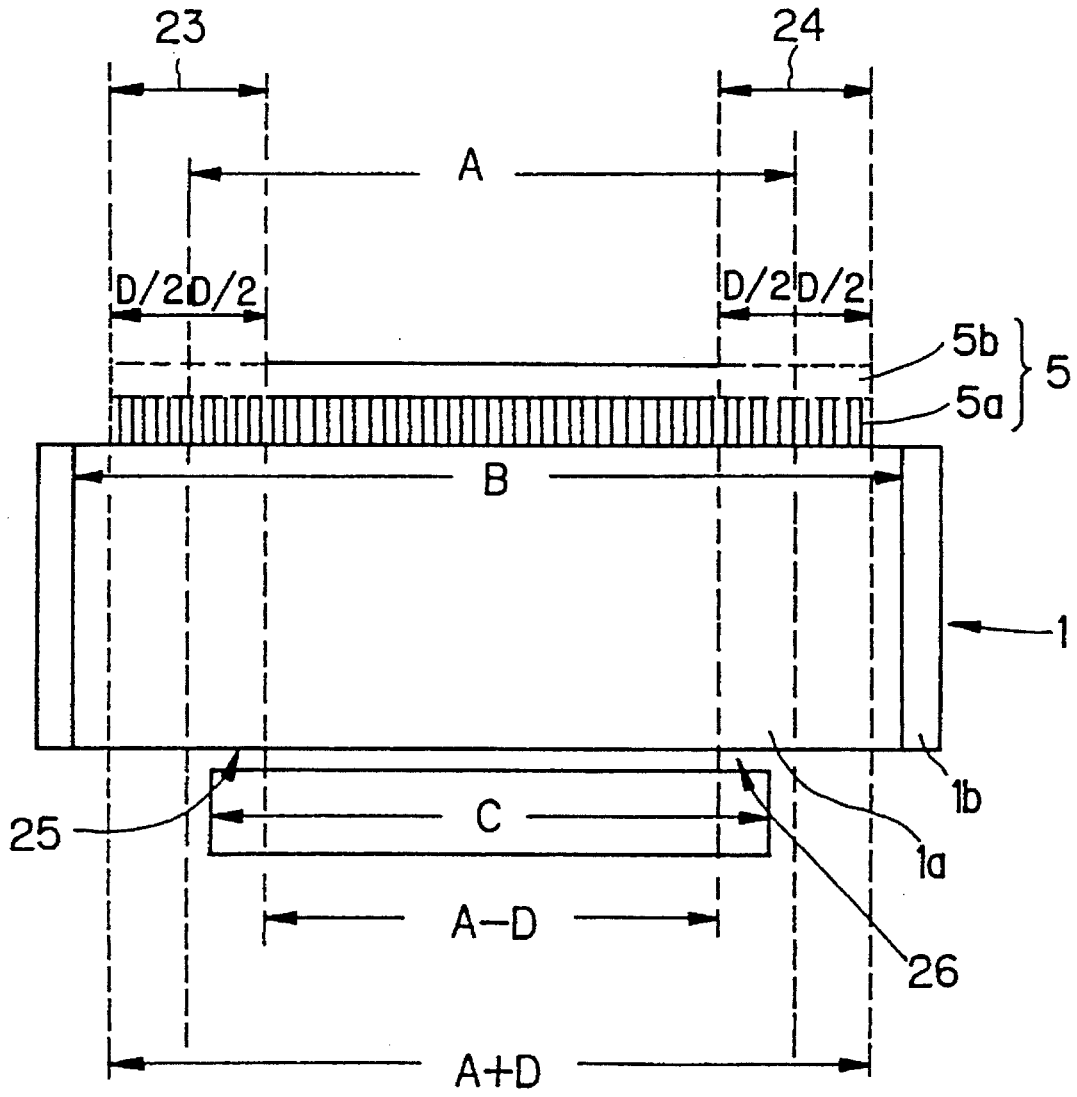
Fig.2 PRIOR ART
FIG. 2 is an illustrative view showing one configuration of another prior art example.
Figure 3:
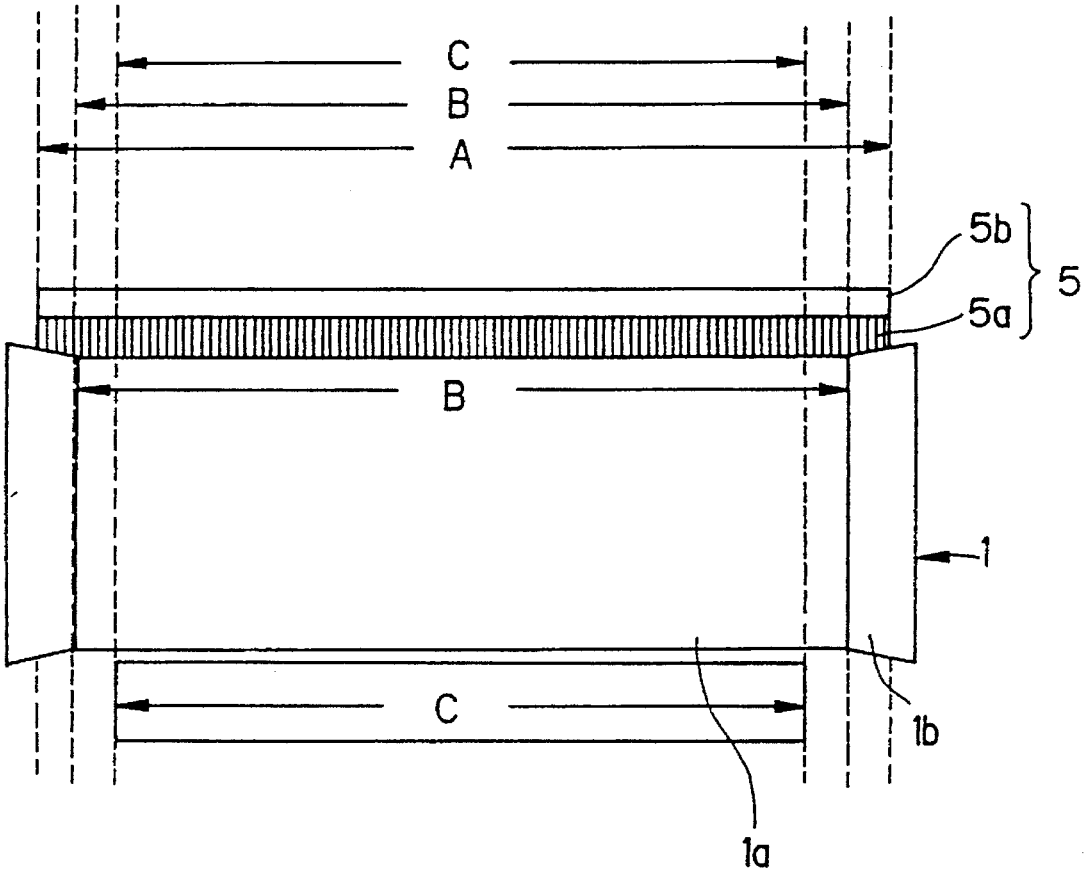
Fig.3 PRIOR ART
FIG. 3 is an illustrative view schematically showing a principle of one prior art system.
Figure 10:
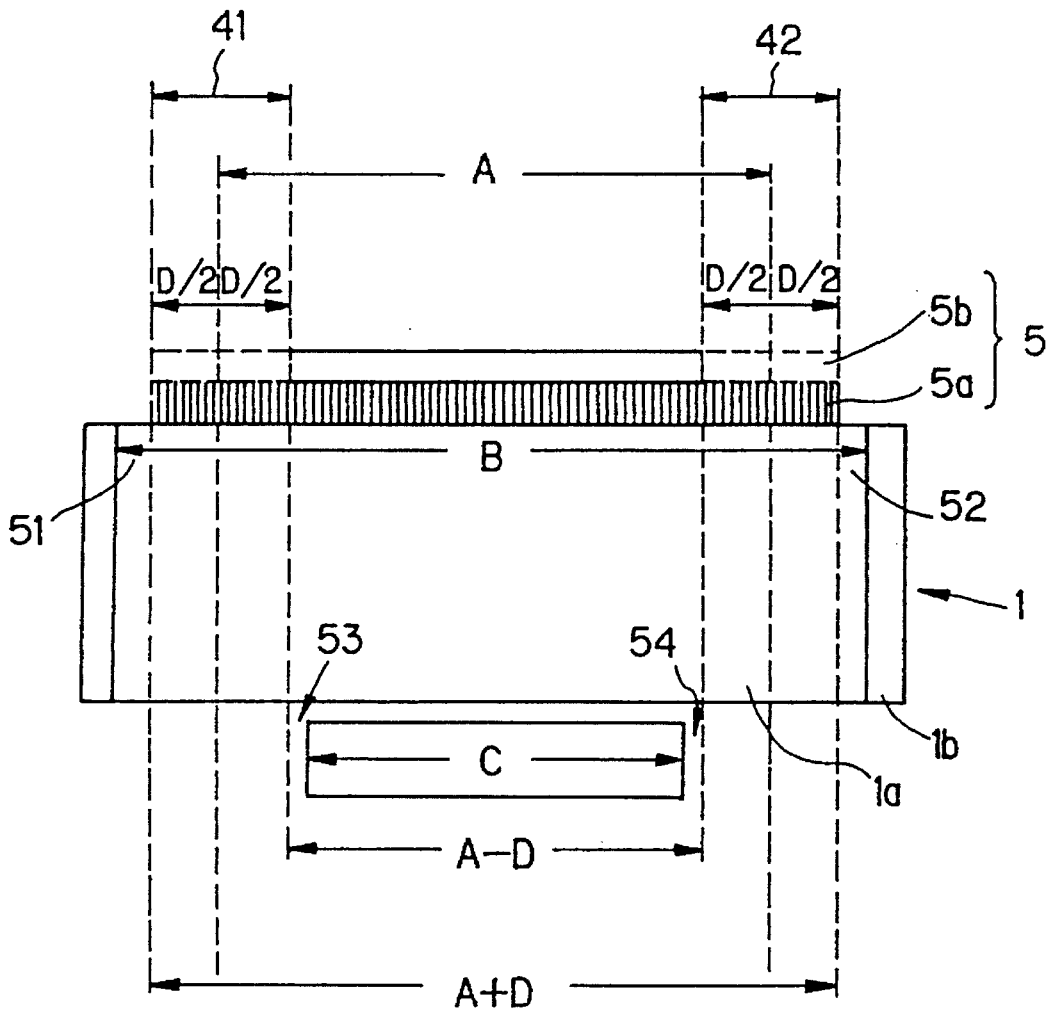
FIG. 10 is an illustrative view showing a configuration of a first embodiment of the present invention.

At the outset, description will be made on size of each element, that i.e., the charging member length A, the effective width B of the photoconductive layer coated range on the charged member, the developing width C and the vibrating width D of the charging member. Specifically, with 240 mm of the effective width B of the photoconductive layer coated range and 217 mm of the developing width C, the charging member length A and vibrating width D were set up as follows:

1) A: 235 mm, D: 8 mm (in the case of B<A+D, refer to FIG. 1),

2) A: 225 mm, D: 12 mm (in the case of C>A−D, refer to FIG. 2),

3) A: 230 mm, D: 8 mm
(in the case of C+D<A<B−D, refer to FIG. 10).

In these conditions, actual operation of the apparatus was carried out and the following evaluation was obtained.

In the case of condition 1)

It was found that the charging brush, as vibrating, came into contact with the conductive substrate portion of the photoconductor, whereby current leak was caused in the regions 21 and 22 and consequently excessive current flowed. Further, damage to the charging brush, or burnt traces caused by the current were observed in both longitudinal extremes of the charging brush. In general, in the case of the brush-type charger, pinhole-wise contact of the charger with the conductive substrate portion does not cause sufficient reduction of the surface potential in the image region as to influence the image quality. However, in this condition, periodical, laterally striped lines were observed on the image at places corresponding to the frequency of vibration of the brush. This is because, when the charging brush is oscillated, the ends of the brush, contact with the conductive portion, and consequently, sufficient charges cannot be supplied to the image region.

In the case of condition 2)

In the initial stage of the use, no defect was observed on the resultant images. However, a great deal of developer adhered to parts on the transfer member corresponding to the outside of the image region or corresponding to regions 23 and 24 having a lower surface potential than a desired level. The adhered toner, if left on the transfer member, might smudge the backside of sheets with images when a contacting type transfer member is used. Alternatively, abnormal discharge might occur when a transfer member such as a corona-discharge type is used. Further, it was observed that development was always effected in regions 25 and 26 so that developer particles, not having been well collected, adhered to the brush over prolonged use, thereby causing charging unevenness and adversely effecting on the resulting images. It was also confirmed that the developer was consumed rapidly increasing cost.

In the case of condition 3)

This setup condition represents a first embodiment of the present invention (FIG. 10). In this condition, no adverse effects as stated in the cases 1) and 2) occurred and good image forming was achieved,. Specifically, neither current leakage occurred in regions 51 and 52 nor did occur undesired development in regions 53 and 54.

Embodiment II

Figure 4:
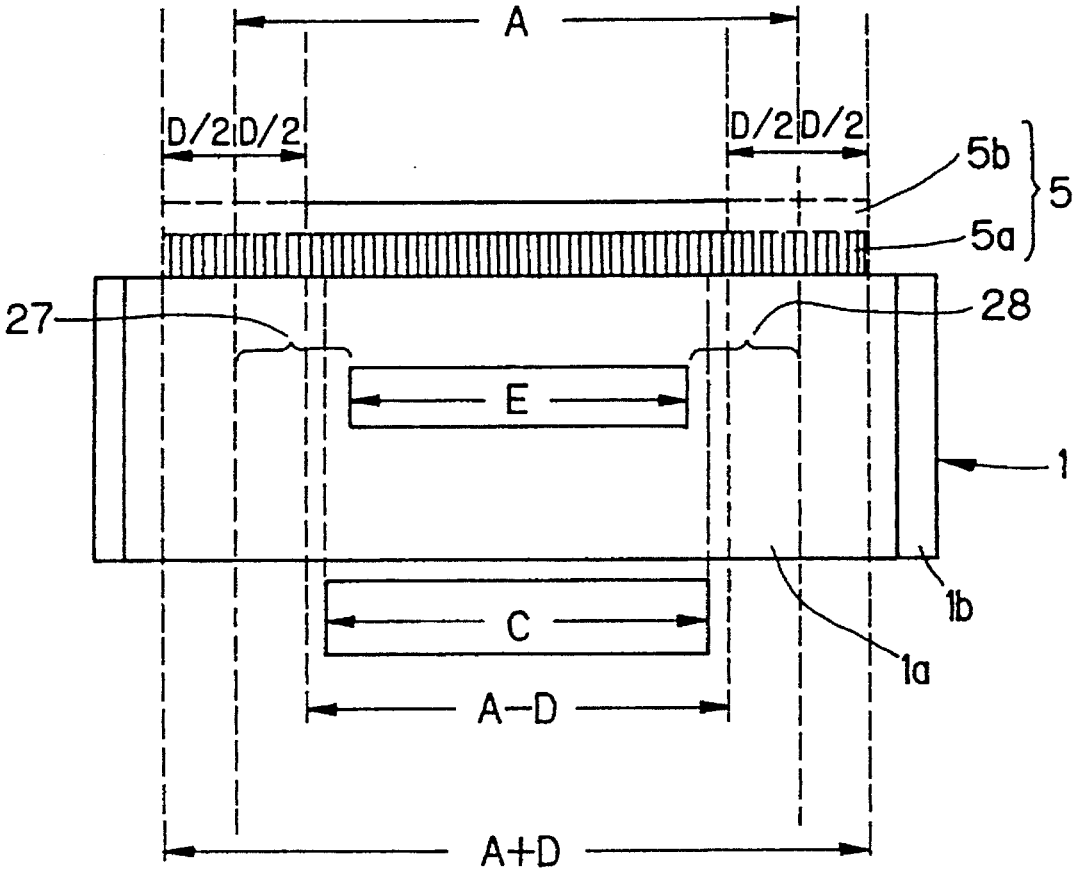
Fig.4 PRIOR ART
FIG. 4 is an illustrative view showing another configuration of one prior art example.
Figure 5:
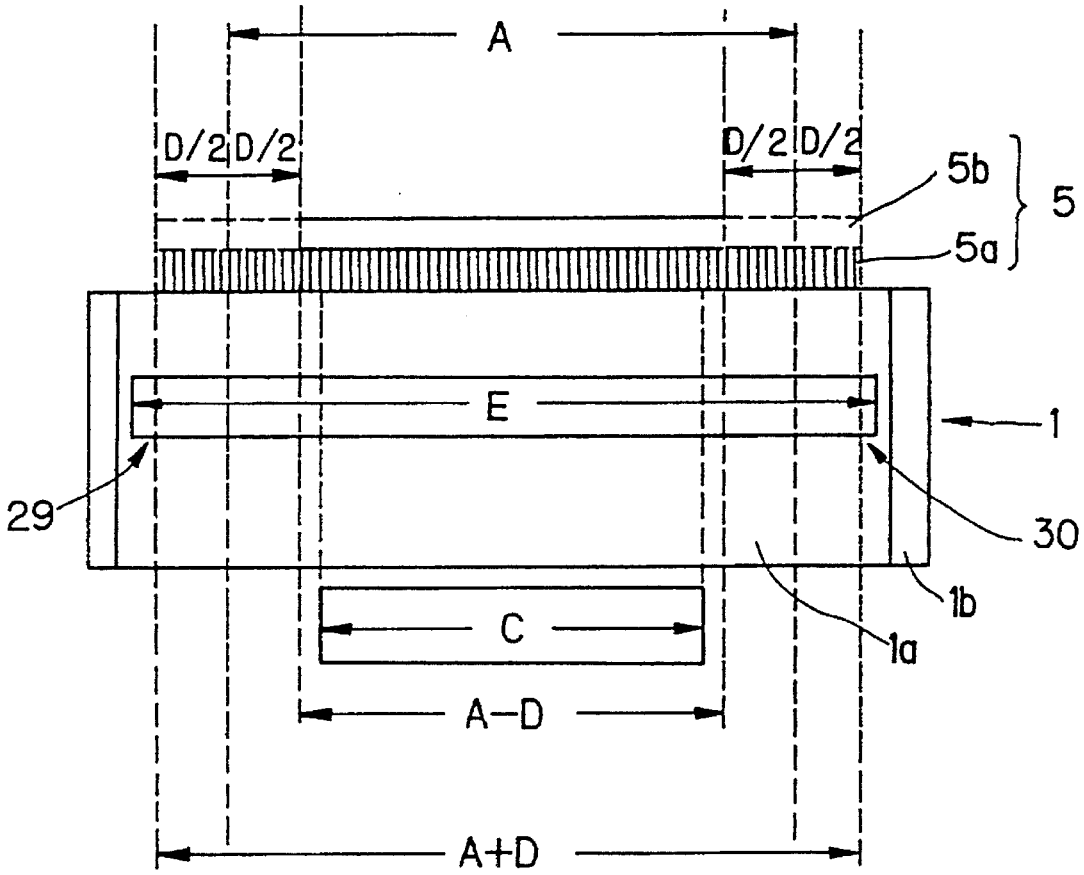
Fig.5 PRIOR ART
FIG. 5 is an illustrative view showing another configuration of another prior art example.
Figure 6:
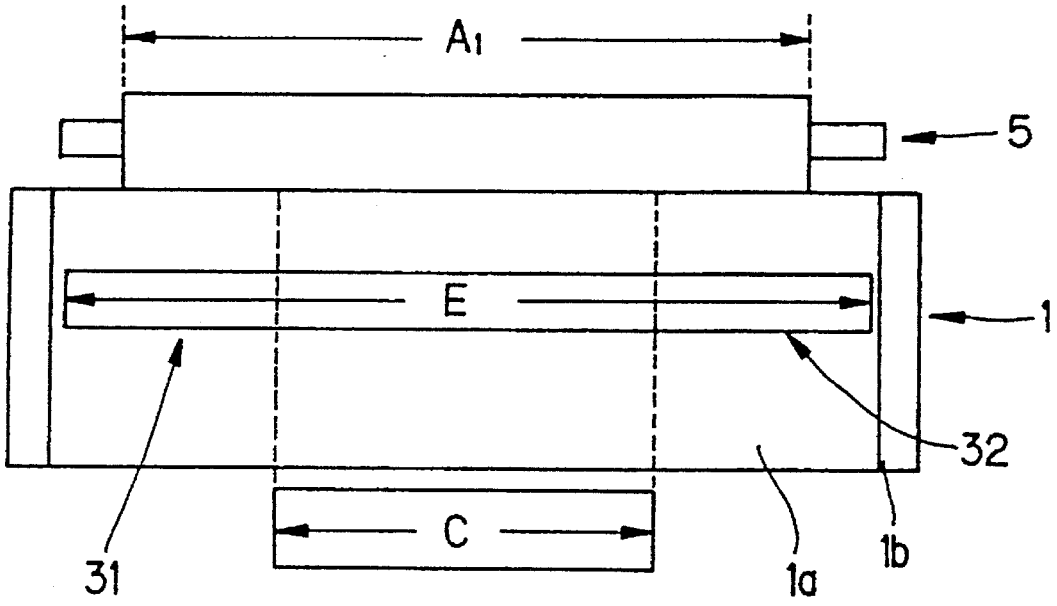
Fig.6 PRIOR ART
FIG. 6 is an illustrative view schematically showing a configuration of another prior art system.
Figure 11:
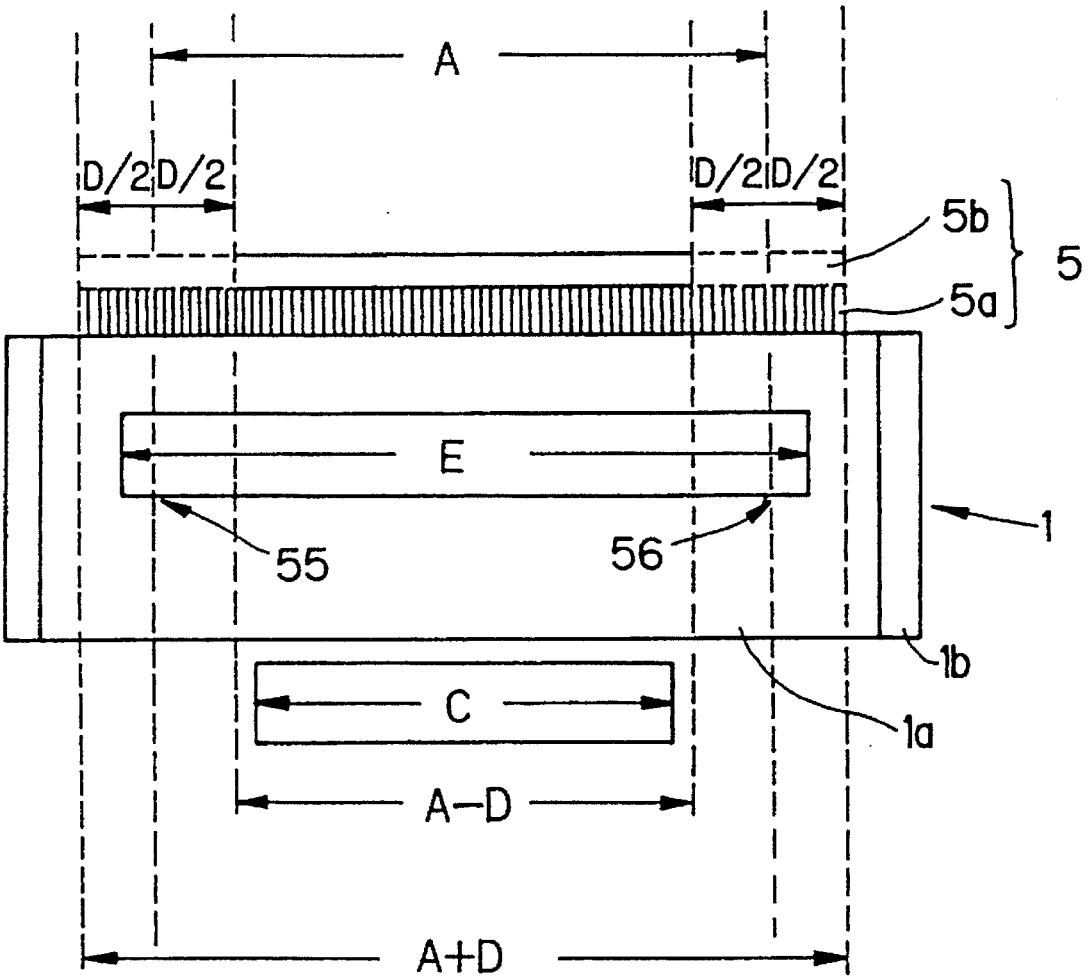
FIG. 11 is an illustrative view showing a configuration of a second embodiment of the present invention.

Next, description will be made on size of the charging member length A, the cleaning member length E, the effective developing width C and the vibrating width D of the charging member. Specifically, with 230 mm of the effective width A, 217 mm of the developing width C and 8 mm of the vibrating width D, the cleaning member length E was set up as follows:

1) E: 210 mm (in the case of E<C, refer to FIG. 4),

2) E: 240 mm (in the case of E>A+D, refer to FIG. 5),

3) E: 230 mm (in the case of C<E<A+D, refer to FIG. 11).

In these conditions, actual operation of the apparatus was carried out, and the following evaluation was obtained.

In the case of condition 1)

There existed regions 27 and 28, in which it was difficult to collect remaining developing particles, without having been transferred. It was observed that this remaining toner had adhered to the charging member. The thus adhered toner particles spread out wider by the vibration of the charging member thereby polluting the image region. Further, prolonged use of the apparatus caused the adhered developer particles to fix to the conductive fiber portions of the charging member. As a result, charging unevenness was brought about, which caused adverse effects on the image forming. To make matters worse, it was observed that conducive fibers which had fallen from the charging brush existed on the photoconductor outside the cleaning region. Moreover, the fallen fibers entangled with the charging brush was also observed. Particularly, when fallen fibers became entangled with the charging brush on the downstream side thereof, the fibers blocked the exposure light, thus decreasing the image quality.

In the case of condition 2)

The cleaning member used in this embodiment was of a blade type. The cleaning member of this kind received large frictional force from the photoconductor in regions in which very few adhered substances existed on the photoconductor, therefore the blade bent backward causing in some cases damage to the charged member.

In the case of condition 3)

This setup condition represents a second embodiment of the present invention (FIG. 11). In this condition, no adverse effects as stated in the cases 1) and 2) occurred and good image forming was achieved. Specifically, in this case, developer particles and fallen fibers were removed properly even in the regions 55 and 56.

Embodiment III

Figure 12:
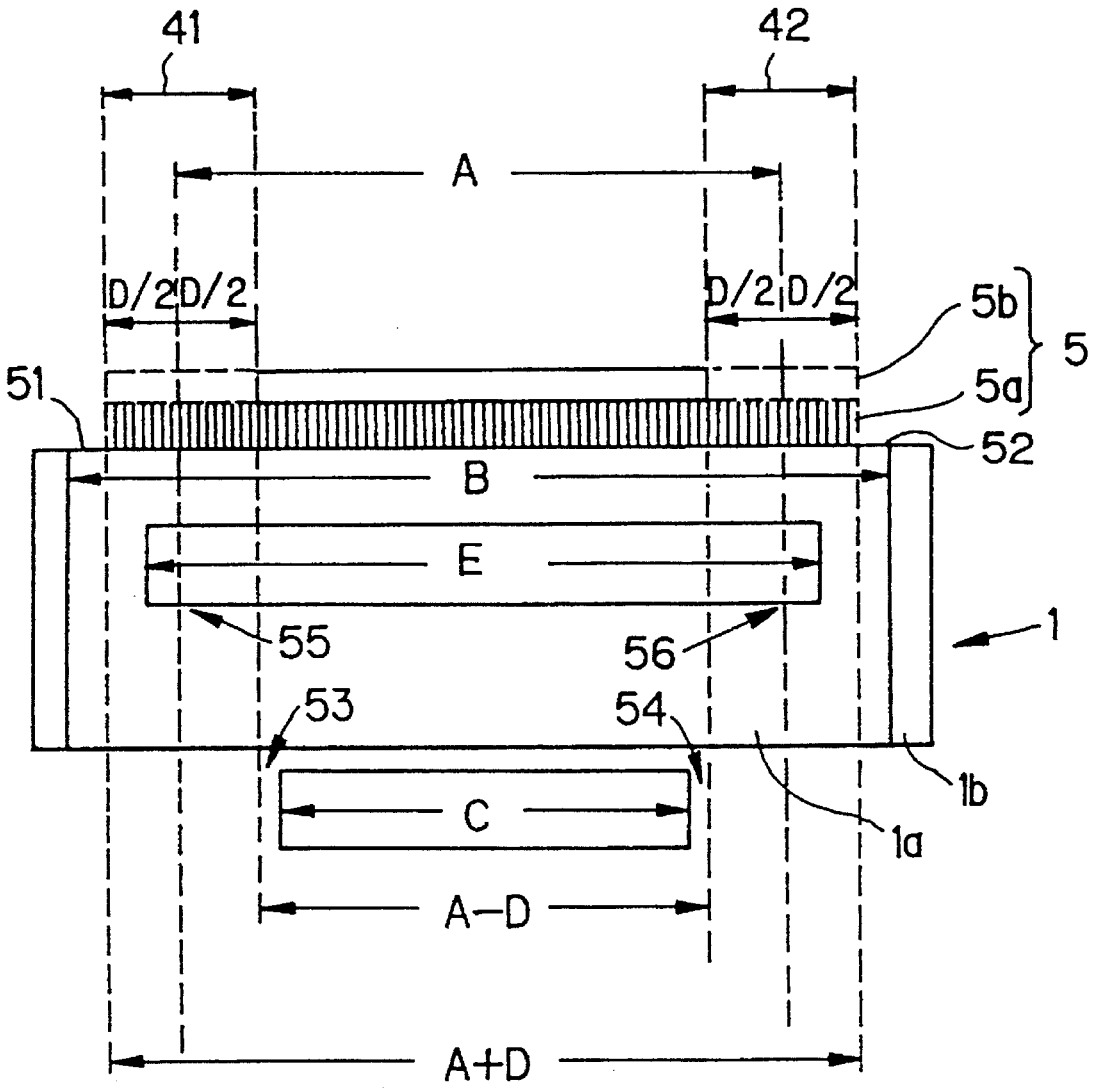
FIG. 12 is an illustrative view showing a configuration of a third embodiment of the present invention.

FIG. 12 shows a structural view showing a third embodiment of the present invention. Here, each size of elements was set up as follows:

| | |
|---|---|
| Charging member length A | 230 mm |
| Effective width B of the photoconductive layer coated range in the longitudinal direction | 240 mm |
| Developing width C | 217 mm |
| Vibrating width D | 8 mm |
| Length E of cleaning member for the charged member | 230 mm |

As a result the following relation holds:

$$C+D<A<B-D \text{ and } C<E<A+D.$$

Image output was performed by using the thus set up image forming apparatus. This set up condition prevented the charging member composed of conductive fibers from being damaged and made it possible to use a developer effectively. Further, good image printing lasted for a long period of time thereby lengthening life of the apparatus. Besides, generation of ozone gas diminished. Here, it stands to reason that, in this case, the effects by both the above-described embodiments shown in FIGS. 10 and 11 can be obtained.

Although the above description of the embodiments refers to flat type brushes as the charging members, a pad-like charging member having a curved portion or the aforementioned roller-shaped charging member as shown in FIG. 9 can be used. Although blade-type cleaning members were described, any other cleaner such as of electrostatic or magnetic cleaning type etc. can be applied to the present invention.

It is to be understood that the invention is not limited to the specific embodiments described above in association with the drawings, and various changes and modifications may be made in the invention without departing from the spirit and scope thereof.

According to the present invention, it becomes possible to provide an image forming apparatus that uses a developer effectively with a charging member composed of conductive fibers and wherein the charging member can be prevented from being damaged so that good image printing can last for a prolonged period of time with reduced generation of ozone gas.

What is claimed is:

1. An image forming apparatus comprising:

a charged member at least a portion of which is coated with a photoconductive layer rotated in a rotating direction by a rotating means;

a charging member including conductive fibers and placed in contact or nearly in contact with said charged member;

means for vibrating said charging member perpendicularly to said rotating direction of said charged member, wherein a voltage is applied between said charging member and said charged member so as to charge said charged member; and a developing unit, wherein said charged member, charging member, and developing unit satisfy the following relation: C+D<A<B−D, where A denotes a longitudinal dimension of said charging member; B denotes a length of the photoconductive layer; C denotes a developing width in the longitudinal direction of the developing unit; D denotes a vibrating width of said charging member.

2. An image forming apparatus according to claim 1 wherein said charging member comprises a charging brush having conductive fibers affixed on a base thereof.

3. An image forming apparatus according to claim 1 wherein said charging member comprises a charging roller composed of a roller shaft with a conductive fiber cloth spirally wrapped thereon.

4. An image forming apparatus comprising:

a charged member at least a portion of which is coated with a photoconductive layer rotated in a rotating direction by a rotating means;

a charging member including conductive fibers and placed in contact or nearly in contact with said charged member;

means for vibrating said charging member perpendicularly to said rotating direction of said charged member, wherein a voltage is applied between said charging member and said charged member so as to charge said charged member;

a developing unit; and a cleaning unit for cleaning said charged member, wherein said charged member, charging member, developing unit, and cleaning unit satisfy the following relation: $C<E<A+D$ where A denotes a longitudinal dimension of said charging member; C denotes a developing width in the longitudinal direction of said developing unit; D denotes a vibrating width of said charging member; and E denotes a longitudinal dimension of a cleaning member.

5. An image forming apparatus according to claim 4 wherein said charging member comprises a charging brush having conductive fibers affixed on a base thereof.

6. An image forming apparatus according to claim 4 wherein said charging member comprises a charging roller composed of a roller shaft with a said conductive fibers including conductive fiber cloth spirally wrapped on the roller shaft.

* * * * *